US006588598B2

(12) United States Patent
Wark

(10) Patent No.: US 6,588,598 B2
(45) Date of Patent: Jul. 8, 2003

(54) MULTI-OUTLET DIFFUSER SYSTEM FOR CLASSIFIER CONES

(76) Inventor: Rickey E. Wark, 4 Watermark Way, The Woodlands, TX (US) 71381

( * ) Notice: Subject to any disclaimer, the term of this patent is extended or adjusted under 35 U.S.C. 154(b) by 0 days.

(21) Appl. No.: 09/901,207

(22) Filed: Jul. 9, 2001

(65) Prior Publication Data

US 2001/0037962 A1 Nov. 8, 2001

Related U.S. Application Data

(63) Continuation-in-part of application No. 09/440,250, filed on Nov. 15, 1999, now Pat. No. 6,257,415.

(51) Int. Cl.[7] ..... B07B 7/04
(52) U.S. Cl. ..... 209/143; 209/721; 209/722
(58) Field of Search ..... 209/5, 142, 143, 209/710, 713, 714, 717, 718, 721, 722

(56) References Cited

U.S. PATENT DOCUMENTS

| | | | | |
|---|---|---|---|---|
| 391,873 A | | 10/1888 | Allington | |
| 1,120,534 A | | 12/1914 | Pruden | |
| 1,315,719 A | | 9/1919 | Grindle | |
| 1,318,375 A | | 10/1919 | Goff | |
| 1,814,395 A | * | 7/1931 | Lykken | 241/5 |
| 2,184,297 A | | 8/1939 | Grindle | |
| 2,510,240 A | | 3/1950 | Mayo | |
| 2,988,220 A | * | 6/1961 | Gracza | 209/714 |
| 3,630,458 A | * | 12/1971 | Smiley | 241/46.06 |
| 4,243,183 A | * | 1/1981 | Eirich et al. | 241/186.3 |
| 4,256,044 A | | 3/1981 | Burton | |
| 4,592,516 A | * | 6/1986 | Tschantz | 241/76 |
| 4,818,376 A | * | 4/1989 | Tanaka et al. | 209/135 |
| 5,463,967 A | | 11/1995 | Gielow et al. | |
| 5,533,629 A | * | 7/1996 | Ito et al. | 209/714 |
| 5,645,381 A | | 7/1997 | Guidetti et al. | |
| 6,318,559 B2 | * | 11/2001 | Cordonnier et al. | 209/154 |

FOREIGN PATENT DOCUMENTS

| | | |
|---|---|---|
| AU | 279767 | 10/1927 |
| AU | 247350 | 10/1963 |
| AU | 1158898 | 12/1963 |
| EP | 735373 | 11/1932 |
| FR | 833453 | 12/1937 |
| JP | 63-259316 | 10/1988 |

OTHER PUBLICATIONS

Derwent Publication #1989–014878 (Author: Naumov et al.; Abstract Pub: SU 1407582A; Pub Date: Jul. 1988).*

* cited by examiner

*Primary Examiner*—Donald P. Walsh
*Assistant Examiner*—Joseph C Rodriguez
(74) *Attorney, Agent, or Firm*—Young & Basile P.C.

(57) ABSTRACT

A diffuser system for multi-outlet pipe structures of the type found in coal pulverizer classifier skirts and in the piping between such classifiers and combustion chambers in coal-fired power plant delivery systems. A plurality of vertical and horizontal diffuser elements comprising toothed bars and rings are arranged in the "skirt" or plenum just prior to the multiple pipe outlets so as to effectively diffuse both axial and radial components of uneven flow distributions.

13 Claims, 11 Drawing Sheets

MULTI-OUTLET DIFFUSER SYSTEM FOR CLASSIFIER CONES

This is a Continuation-in-part of application Ser. No. 09/440,250 filed Nov. 15, 1999, now U.S. Pat. No. 6,257,415.

FIELD OF THE INVENTION

The present invention is in the field of multi-outlet structures of the type found in the flow path between coal pulverizing mills and combustion chambers in coal-fired power plants, and in particular found in the classifier cone structure at the upper end of such mills and in the branches of piping between the classifier and the combustion chamber.

BACKGROUND OF THE INVENTION

In the field of coal pulverizing mills there are generally two types of mills, characterized by the manner in which the pulverized coal is delivered from the mills to a combustion chamber: "suction" mills using exhauster fans to pull the pulverized coal fines from the mill through discharge pipes; and, "pressurized" mills which are fanless and typically entrain the pulverized coal fines in a stream of pressurized air originating at the mill itself.

Each type of mill presents its own problems with respect to the goal of supplying an even, balanced flow of coal fines through multiple pipes to multiple burners in the combustion chamber. In suction mills, for example, the exhauster fan tends to throw coal in an unbalanced stream, with heavier particles settling out to one side of the flow through the pipe and lighter fines on the other. In pressurized mills without exhauster fans, distribution problems tend to occur as a result of the varying lengths of discharge pipe leading from the top of the classifier to the various burners around the combustion chamber. Shorter lengths of discharge pipe generally run rich with air only (but tend to run lean in coal), while longer lengths of pipe tend to run lean in air only (but tend to run rich in coal).

Rich/lean imbalances among the various burners in the combustion chamber produce the usual problems: loss on ignition (LOI) contamination of the ash byproduct; NOX formation; fireball distortion and waterwall erosion; and others known to those skilled in the art.

One common technique for trying to balance coal flow in pipes of different length is known as "clean air flow testing", in which orifice plate restricters are placed in the shorter pipes to try to balance air flow with respect to the longer (slower, lower volume) pipes in an air-only test procedure. The problem with clean air flow testing is that, having balanced air flow in a theoretical test, the introduction of coal fines produces fundamentally different results than the air-only testing would indicate, and the orifice plates worsen distribution problems among and within the pipes. As a result, further efforts have attempted on-line adjustable orificing with coal flow present, with similarly disappointing results.

Another approach to balancing coal flow among multiple pipes has been to use a "dynamic" classifier. Dynamic classifiers power-rotate an array of vanes in the classifier cone to decelerate larger particles of coal and encourage lighter fines to travel up and out the classifier into the discharge pipes. It has been found, however, that the use of dynamic classifiers still results in + or −20% differences in distribution among the pipes (resulting in a 40% variance).

SUMMARY OF THE INVENTION

The present invention is believed to be the first based on a recognition that redistributing the coal fines immediately adjacent the discharge pipe outlets in a multi-outlet branch structure of the type found at the top of the classifier solves a majority of the downstream distribution problems. In accordance with this recognition, the invention resides in a novel, passive diffuser structure to achieve uniform distribution of coal fines among the individual pipe outlets at the top of the classifier.

In its broadest structural form, the invention is a series of diffuser elements located in the upper end of the classifier, within the cylindrical or annular "skirt" usually found surrounding the pipe outlets. The diffuser elements are preferably arranged in concentric rings within the skirt, with a first inner "ring" at or near an inner surface of the skirt, and a second outer "ring" arranged at or near an outer surface of the skirt. In a further preferred form, the diffuser elements are circumferentially located both between and aligned with the pipe outlets.

The diffuser elements in a first form comprise rows of serrations or teeth arranged vertically (i.e., generally aligned with the axial flow) with their serrations or teeth projecting into the interior volume of the skirt generally perpendicularly to centrifugal/radial components of the flow. In a preferred, illustrated form they comprise serrated or toothed bars. It will be understood that the terms "serrations" and "toothed" are not intended to limit the invention to any particular geometric form or pattern of the teeth, as they may be pointed, rounded, truncated, squared, etc. They are, however, preferably arranged in alternating high/low patterns along the length of each diffuser element.

In a second form, the diffuser elements comprise horizontally arranged (i.e., generally perpendicular to the axial flow) diffuser elements located in the interior volume of the skirt. The teeth of a horizontal diffuser element are generally perpendicular to axial components of the flow. In the preferred form at least one horizontal diffuser element is a ring diffuser and various combinations of ring diffusers can be placed in concentric relationship to one another. Concentric arrangements of ring diffusers may be in the same plane or may be stacked one above the other in the skirt. The ring diffusers may also be used in combination with the vertical diffuser elements and other horizontal diffuser elements. The ring diffuser element need not be literally a ring, as its geometry will preferably follow that of the pipe or outlet structure, for example in a square configuration.

The inventive diffuser structure is effective not only in multi-outlet classifier skirts, but also in the multi-outlet branch structures found in the piping between the pulverizers/classifiers and the combustion chamber burners. Such multi-outlet branch structures are similar to the multi-outlet classifier skirts, having a pre-outlet volume or plenum which presents a flow path axially head-on to a symmetrical array of individual pipe outlets each having an area significantly smaller than the area of the chamber or plenum feeding the multi-outlet array.

While the present invention is especially designed to provide even distribution to a multi-outlet structure like that in a classifier, it also has utility with riffle-box type pipe junctions and can improve the performance of riffle boxes in providing evenly-split flows to two angled pipes. Likewise, the present invention can be used virtually anywhere in the piping of virtually any coal-fed combustion chamber system (e.g., just prior to the burner itself) where diffusion is critical.

These and other advantages and features of the invention will become apparent upon further reading of the specification in light of the accompanying drawings.

DETAILED DESCRIPTION OF THE ILLUSTRATED EMBODIMENT

Figure 1:
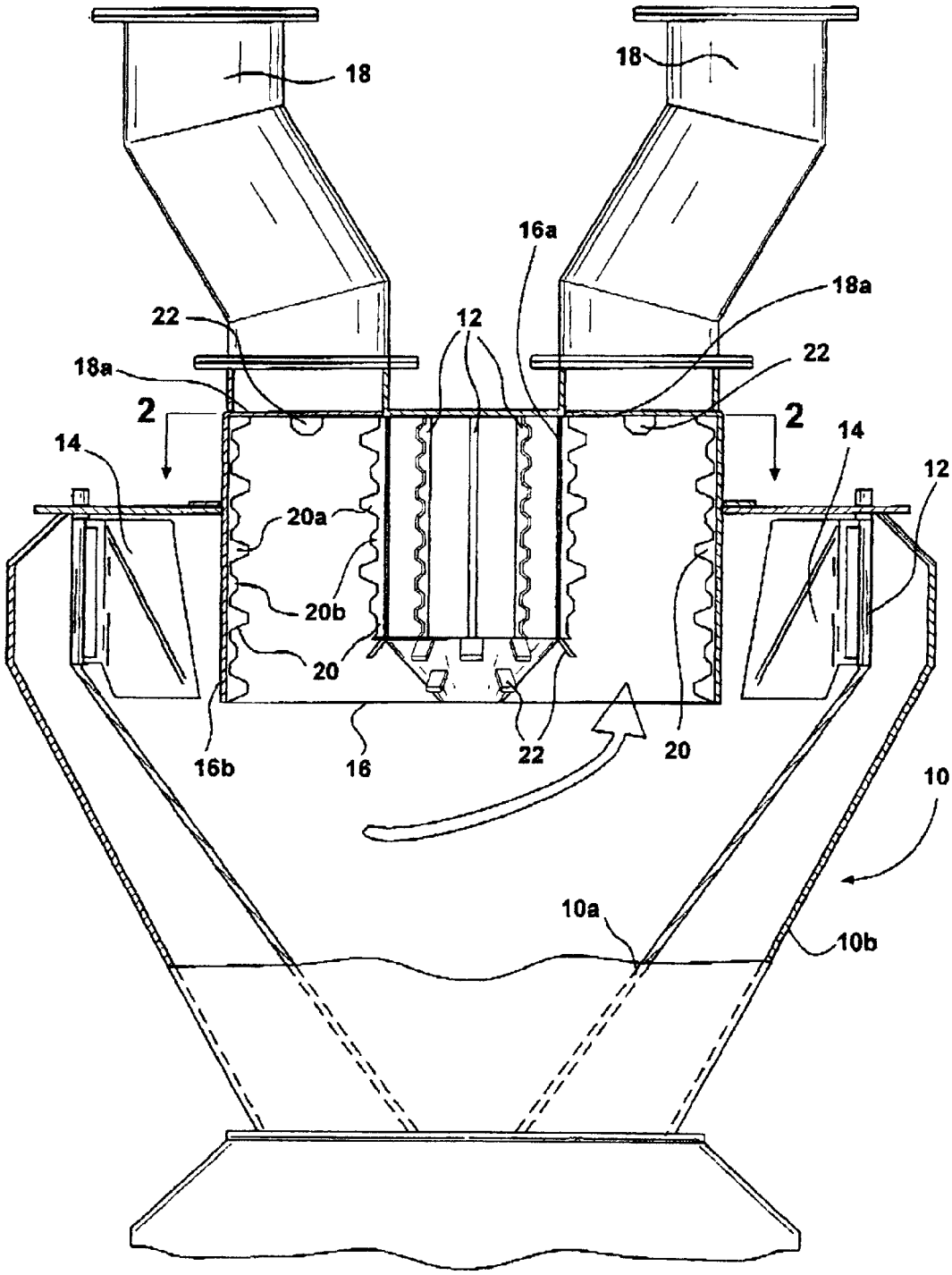
FIG. 1 is a side elevational view, in section, of a classifier equipped with a first embodiment of the present invention in the annular "skirt" surrounding the coal pipe outlets at the top of the classifier.

Referring first to FIG. 1, a standard classifier of known, commercially available type is generally denoted by reference numeral 10, comprising an inner cone 10*a* and an outer cone 10*b*. The upper end of the cone structure is capped by a classifier cage 12 comprising a circular array of classifier vanes 14 which, in known manner, are used to direct coal fines from the pulverizer onto the inner cone surface in a manner designed to enhance the swirling, centrifugal classifying action of the cone. Heavier coal fines drop out the bottom of the cone, while lighter coal fines are swirled up and out the top of the classifier through an annular skirt 16 and into multiple outlets 18*a* connected to a plurality of coal discharge pipes 18 which lead to burners in a combustion chamber. To this point all of the structure described is known.

While the illustrated embodiment is shown with a cone-type classifier, it will be understood by those skilled in the art that the invention can be used in other types of classifiers, and in multi-outlet pipe structures similar to skirt 16 and outlets 18*a* in the piping between the classifier and the combustion chamber.

The annular skirt in the illustrated embodiment of FIG. 1 has an inner wall 16*a* and an outer wall 16*b* defining an annular volume around which the discharge pipe outlets 18*a* are spaced. It is in this annular volume, and in particular at the pipe inlets, that distribution problems begin. Specifically, each of the four pipes 18 is typically of different length, thereby affecting the air flow through them. This imbalance in air flow is reflected in the pattern of fines swirling in the annular volume of the skirt as they approach and enter the various pipe outlets 18*a*. It is typical for the individual flows of coal entering the pipe outlets to be significantly imbalanced as they leave the classifier. One particular problem is known as "roping", in which a tornado-like, rich concentration of coal spirals up and out the classifier toward the discharge pipe outlets, inevitably creating an imbalance as the rope favors one or more pipes over the others.

The first form of the present invention resides in a plurality of diffuser elements 20, in the illustrated embodiment in the form of a plurality of vertically-arranged, serrated or toothed bars formed from a suitably abrasion-resistant material such as steel. Diffuser elements 20 are arranged vertically on the inner and/or outer walls 16*a*, 16*b* of the skirt, secured thereto by known methods such as bolting or welding, preferably running the entire vertical length of the inner and outer walls, respectively. The teeth or serrations 20*a*, 20*b* of the diffuser elements 20 project radially (laterally) inwardly into the circumferentially-swirling coal fines in the annular volume of the skirt so as to intersect and disrupt the pattern of fines. Diffuser elements 20 are located at the inner and outer walls, since the coal tends to distribute itself unevenly with light and heavy concentrations at the inner and outer walls.

It will be understood that the use of "vertically" and "laterally" herein refer to ranges or overall orientation, and not strictly to orthogonally perfect directions. Diffuser elements that are generally more vertical than horizontal, and teeth projecting into the circumferentially-swirling coal flow generally more laterally thereto than parallel, fit within the definitions used herein.

As the swirling coal fines, and in particular the uneven distribution concentrations, encounter the teeth of the diffuser elements, the uneven distributions are disrupted and the fines re-distributed in diffuse fashion within the annular volume of the skirt so that the coal flow in the various pipe outlets is evenly balanced among them.

Figure 2:
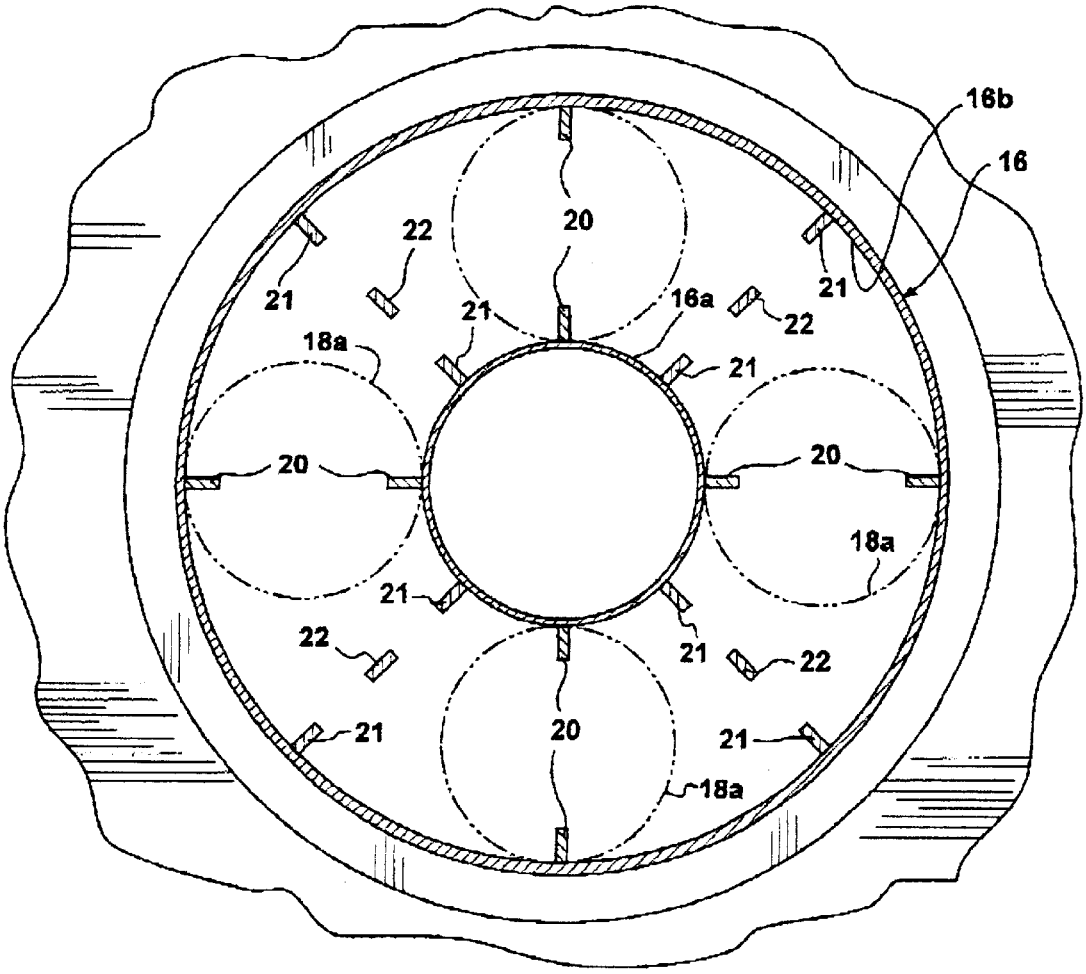
FIG. 2 is a plan view of FIG. 1.

Referring to FIG. 2, two sets of diffuser elements are illustrated: first set 20 in which inner and outer diffuser elements are aligned with pipe outlets 18*a*, and diffuser elements 21 located in the skirt between outlets 18*a*. While it is preferred to use diffuser elements both aligned with the pipe outlets and between the outlets, it may be possible in certain installations to use one or the other and still achieve good results.

It will also be apparent to those skilled in the art that it may be possible to use one or the other of the inner and outer sets of diffuser elements 20, 21, depending on the distribution problems encountered in a particular installation. It will be preferred, however, to use both the inner and outer sets on the inner and outer walls 16*a* and 16*b* of an annular skirt for optimum diffusion.

It is also possible to add additional diffuser elements, for example in the form of shortened diffuser elements or tabs 22 located between diffuser bars 20 and 21, at the level of the pipe outlets 18*a* and around the lower end of inner wall 16*a* of skirt 16 as best shown in FIG. 1. These and other types and placements of diffuser bars and tabs will be apparent to those skilled in the art, depending on the distribution problems encountered in the particular classifier, now that I have disclosed the preferred embodiment of my invention.

Figure 3:
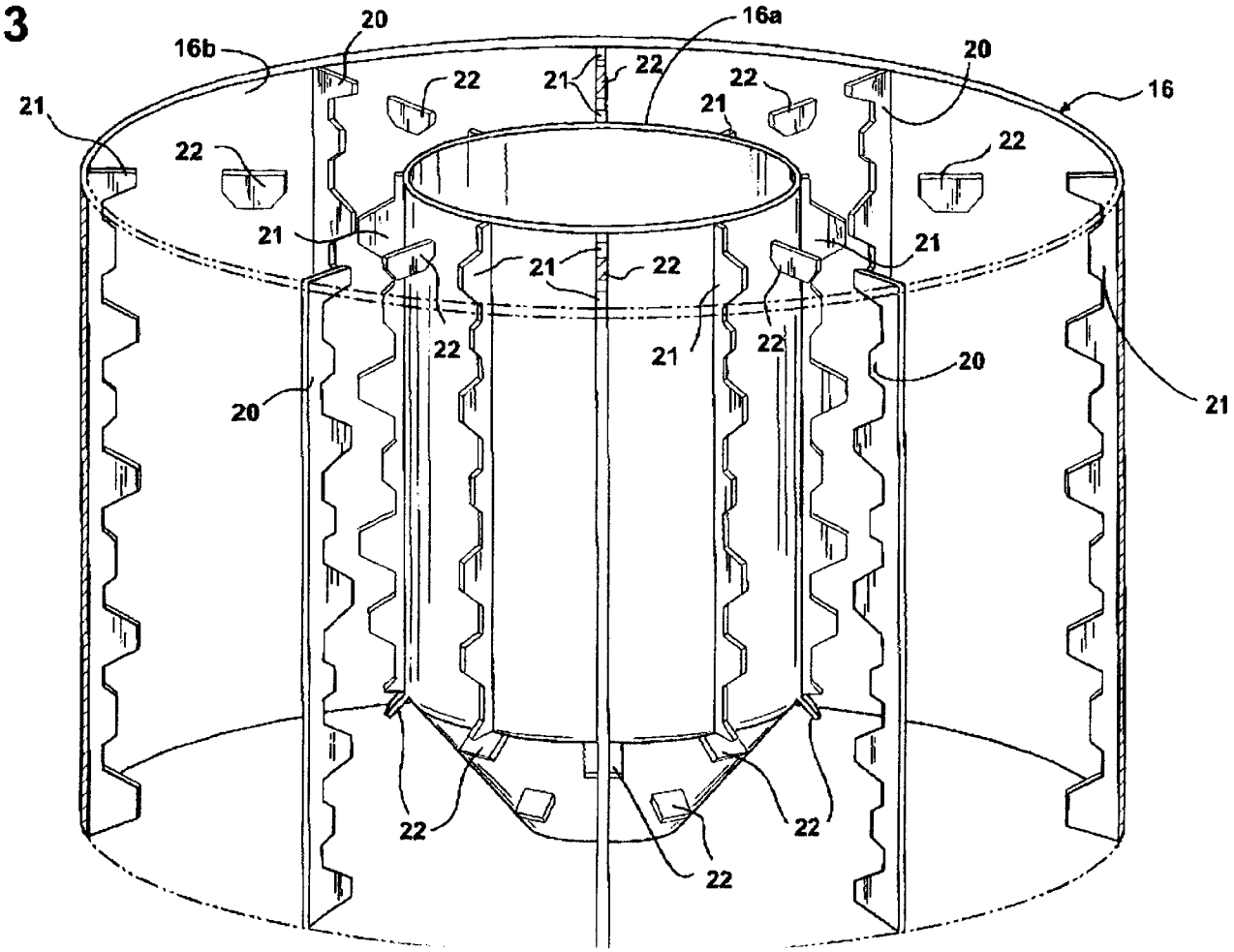
FIG. 3 is a perspective view of the invention-equipped skirt at the upper end of the classifier.

FIG. 3 is a schematic, perspective representation of the classifier of FIGS. 1 and 2 equipped with diffuser bars according to the invention. It can be seen how the diffuser bars disrupt and evenly distribute the coal flow concentrations which tend to occur in the swirling fines inside the skirt.

The length of the diffuser elements 20, their placement inside the skirt, and the shape and size of their teeth or serrations are all subject to variance, depending on the desired diffusion effect for the coal distribution problems encountered in a particular classifier installation.

Generally, however, the bars will be vertically arranged on the wall surfaces of the skirt. A high/low alternating sequence of teeth or serrations is preferred, although the shape (rounded, pointed, truncated, squared) can vary, with the illustrated pattern currently being preferred. The diffuser elements preferably extend from as close to the pipe outlets 18*a* as practicable as far down into the classifier as practicable, with the illustrated full-length diffuser elements being a preferred arrangement for diffusion along the entire interior wall surface of the skirt.

It will be understood by those skilled in the art that while the diffuser elements have been illustrated as serrated or toothed bars secured to the interior of the classifier by known methods such as bolting or welding the bars to the walls of the classifier, the diffuser elements can be formed integrally in the classifier during the manufacture of the classifier itself, for example by forming vertical rows of the teeth or serrations 20*a*, 20*b* in the walls of the classifier. It is also possible to add the teeth or serrations 20*a*, 20*b* to the classifier walls singly rather than in pre-formed bars containing multiple teeth, although the pre-formed bar arrangement illustrated is preferred.

It will also be apparent to those skilled in the art that the position of the diffuser elements in the skirt will depend on the type of skirt employed in a particular classifier. Whereas the annular skirt 16 illustrated in FIGS. 1 and 3 is common, other types of skirt will be known to those skilled in the art.

Figure 4:
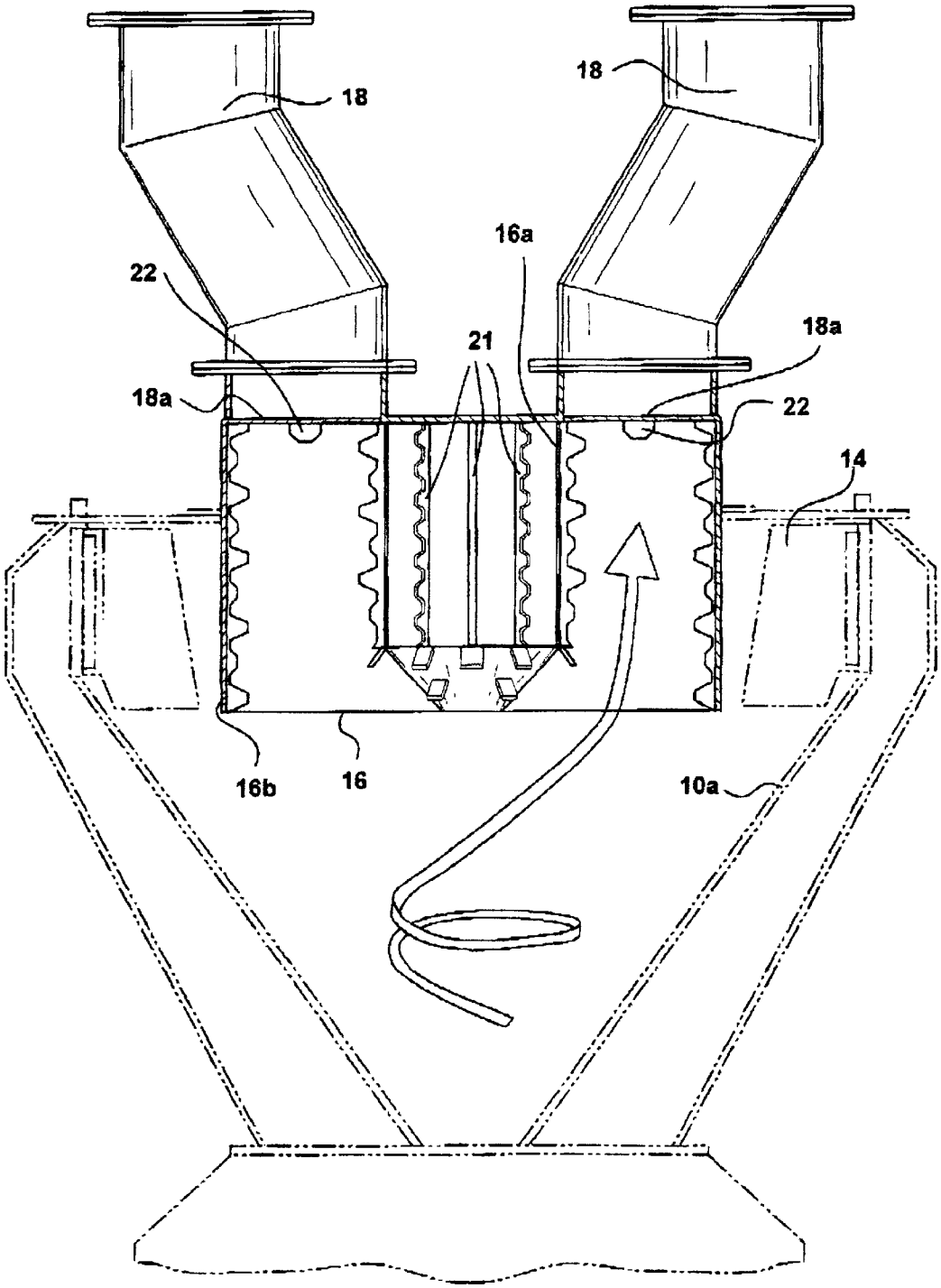
FIG. 4 illustrates the diffuser-equipped multi-outlet structure of FIG. 1, in which "channeling" of a significant portion of the coal flow between the vertical diffuser elements escapes diffusion.

Referring next to FIG. 4, the centrifugal "roping" of the coal flow, as illustrated in FIG. 1, may take on a primarily vertical component, in which case it is described as "channeling" vertically up between the inner walls of the skirt 16 and the vertical wall-mounted diffuser elements 20. In this case, diffuser elements 20 designed primarily to break up the swirling, centrifugal components of flow are insufficient to provide an even distribution to the multiple pipe outlets at the top of the skirt. To address the situation where an uneven distribution of coal flow through a pipe or chamber such as skirt 16 has a primarily vertical component, or both vertical and radial/centrifugal components, the vertical diffuser bar structure illustrated in FIGS. 1–3 is either replaced or supplemented with a second embodiment of the invention as illustrated in FIG. 5.

Figure 5:
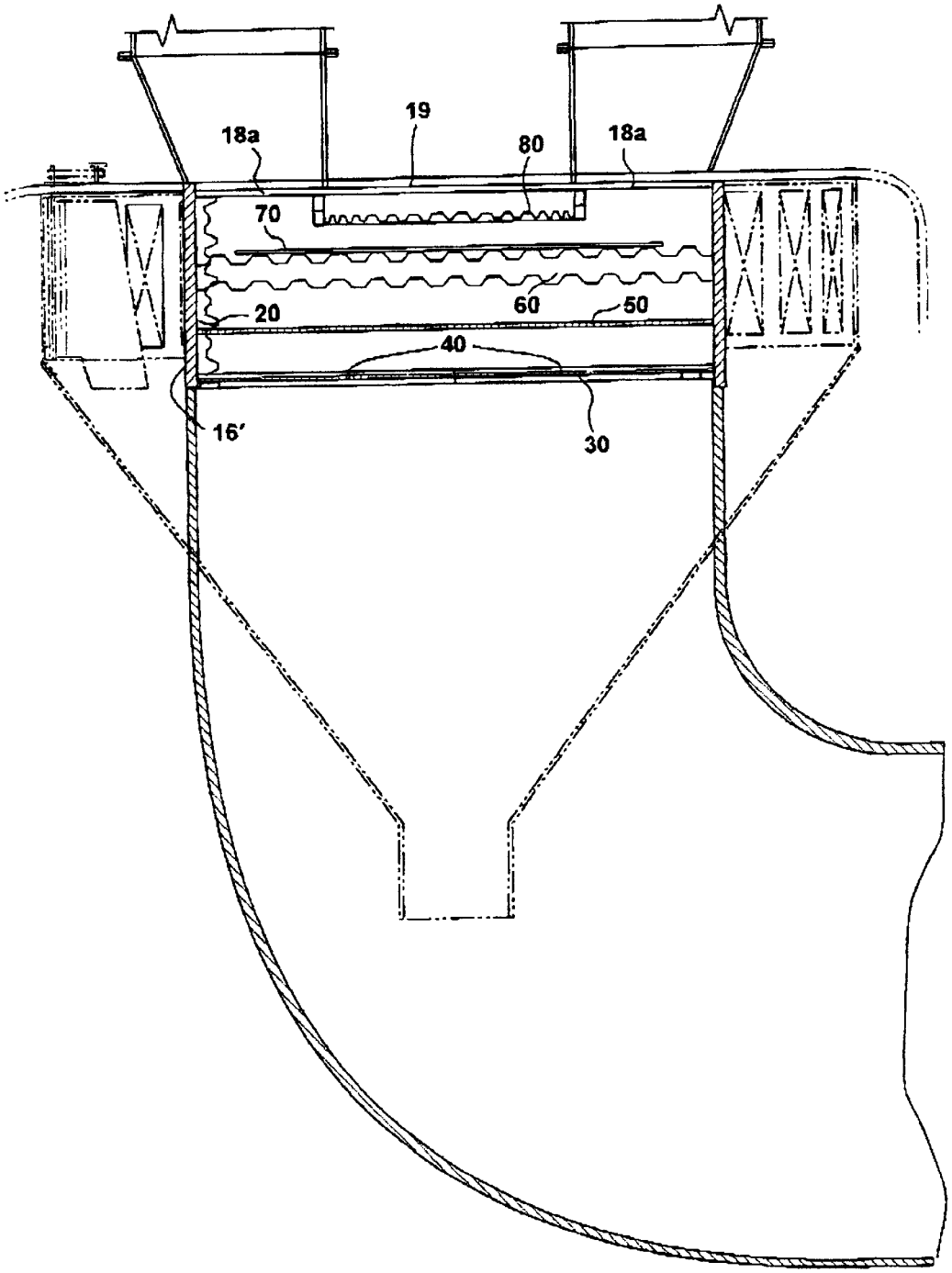
FIG. 5 is a side elevational view, in section, of a multi-outlet pipe structure of the type found in the upper ends of classifiers, and also in the intermediate piping between classifiers and combustion chambers, showing a second embodiment of the invention in the form of a stacked array of horizontal diffuser elements used in conjunction with the vertically arranged radial elements shown in FIGS. 1–3.

Referring to FIG. 5, vertical diffuser bars 20 are illustrated in an extension of pipe 116 forming the plenum of a multi-outlet structure in the piping between the classifier and a combustion chamber. Diffusers 20 on the sidewall surfaces of "skirt" 16' are supplemented with an array of horizontal diffuser elements 30, 40, 50, 60, 70 and 80.

Although vertical channeling can occur in classifier skirts, the radial/centrifugal nature of the classifying action in a classifier cone tends to produce a more centrifugal roping effect which vertical diffuser bars 20 are designed to handle. Channeling with its more vertical or axial orientation is more likely to occur and is more extreme in longer runs of pipe. However, long runs of pipe are often interrupted by multi-outlet pipe branching structures similar to classifier skirt 16, i.e., with a plurality of outlet openings essentially perpendicular to and arranged symmetrically around the axis of a pre-outlet chamber or plenum (here, the pipe itself or a housing added to the pipe), each outlet opening having an area substantially less than the flow area of the pre-outlet plenum. The diffuser structure of FIG. 5 accordingly is illustrated in a generic multi-outlet structure which could either be the multi-outlet skirt of a classifier cone (shown in broken lines) or the pre-outlet plenum in a run of large diameter pipe anywhere between the classifier and the combustion chamber (shown in solid lines).

Like diffuser elements 20 in FIGS. 1–3, diffuser elements 30, 40, 50, 60, 70, 80, are made from a known wear-resistant material such as a suitably hardened or surfaced steel. Depending on its diameter, each diffuser ring may be secured directly at its periphery to the sidewall of the pipe/skirt with known methods such as bolting or welding, or it may be supported by lateral ribs or spokes extending to a sidewall of the pipe/skirt. Each ring diffuser element is a substantially flat ring whose teeth or projections 30*a*, 40*a*, 50*a*, etc., extend either generally parallel or perpendicular to the plane of the ring itself. Like the teeth of vertical diffuser elements 20, the teeth may take various shapes such as rounded, pointed, truncated, square, and the extent to which they project from the ring can vary in various symmetrical and asymmetrical patterns.

While ring diffuser elements 30 and 70 are shown as flat rings having teeth arranged to be substantially perpendicular to the axial component of flow through the pipe/skirt, ring 80 is a horizontally-placed but vertically-oriented ring whose teeth are generally parallel to the axial component of flow through the pipe, but are substantially perpendicular to the radial/centrifugal component of flow through the pipe/skirt. The vertical diffuser ring 80 is able to diffuse centrifugal components of flow which may develop on the interior of the pipe/skirt, in particular adjacent pipe outlets 18*a* where swirling and eddying occur among those portions of the coal flow which strike the outlet plate 19 in the regions between outlets 18*a*.

The foregoing ring diffuser elements can be supplemented with lateral diffuser bars 40, 50 for diffusing axial components of channeling flow between the rings and in alignment with and between outlets 18*a*.

The foregoing horizontally-oriented lateral diffuser bars can be supplemented with one or more vertically-oriented bars such as 60 whose teeth are generally parallel to the axial component of flow through the pipe, but are substantially perpendicular to the radial/centrifugal component of flow through the pipe/skirt to diffuse centrifugal components of flow which may develop on the interior of the pipe/skirt.

Accordingly, diffuser elements 20 handle the radially outermost components of centrifugal flow; horizontal rings 30, and 70 diffuse axial components of channeling flow passing between diffuser elements 20; vertical ring element 80 and vertical bar element diffuse 60 radially interior components of centrifugal flow; and lateral elements 40, 50 diffuse axial flow components in between.

Figure 5A:
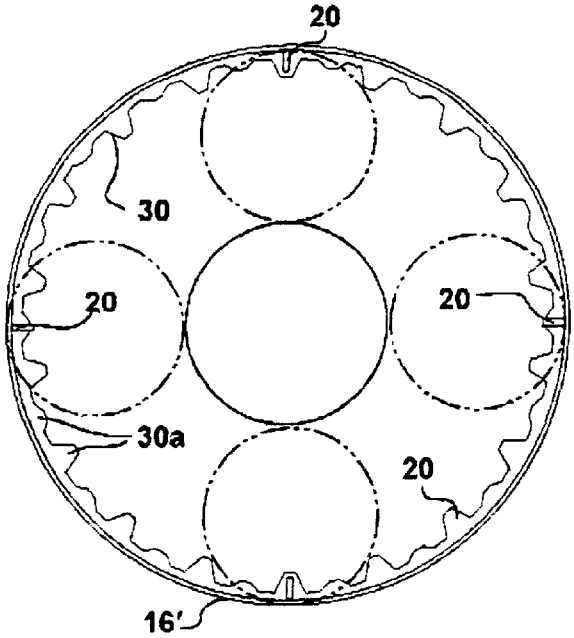
FIGS. 5A–5F are cumulative plan views of the exemplary array of successive horizontal diffuser elements of FIG. 5, from bottommost to topmost.

Referring to FIG. 5A, lowermost horizontal diffuser ring 30 is illustrated as being secured to the inner wall of pipe/skirt 16', with inwardly facing teeth 30*a* projecting radially into the interior of pipe/skirt 16' in a manner so as to be substantially perpendicular to the axial component of flow through the pipe. Accordingly, axial flow through pipe/skirt 16' concentrated toward the outer edge of the pipe will be diffused around the periphery of the pipe/skirt.

Figure 5B:
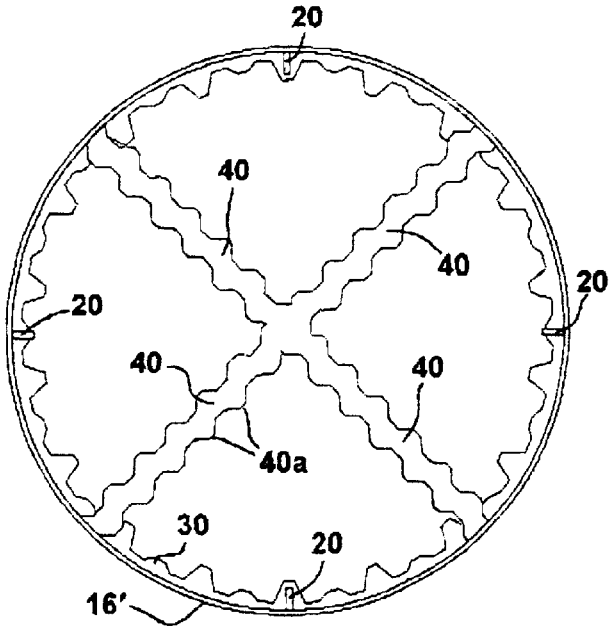

Referring to FIG. 5B, flat diffuser crossbars 40 are shown in substantially coplanar alignment with diffuser rings 30, extending laterally across the flow diameter of the pipe diameter of pipe/skirt 16' to diffuse axial components of flow in the regions intersected by them.

Figure 5C:
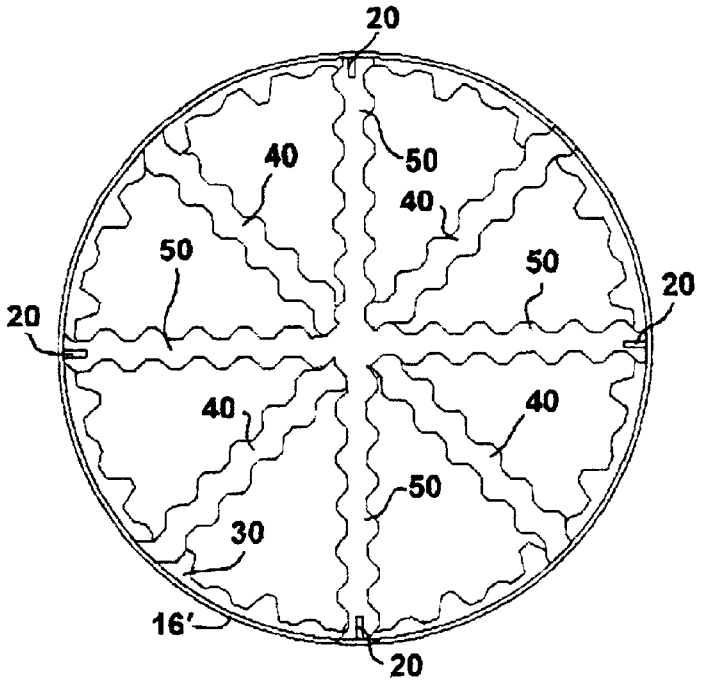

Referring to FIG. 5C, diffuser crossbars 50 are shown located above and between crossbars 40 to diffuse those axial components of flow intersected by bars 50 between bars 40. The spacing of bars 50 above (downstream from) bars 40 serves to prevent excessive pressure drop caused by sudden stricture of flow area in a single planar segment of the pipe/skirt 16'.

Figure 5D:
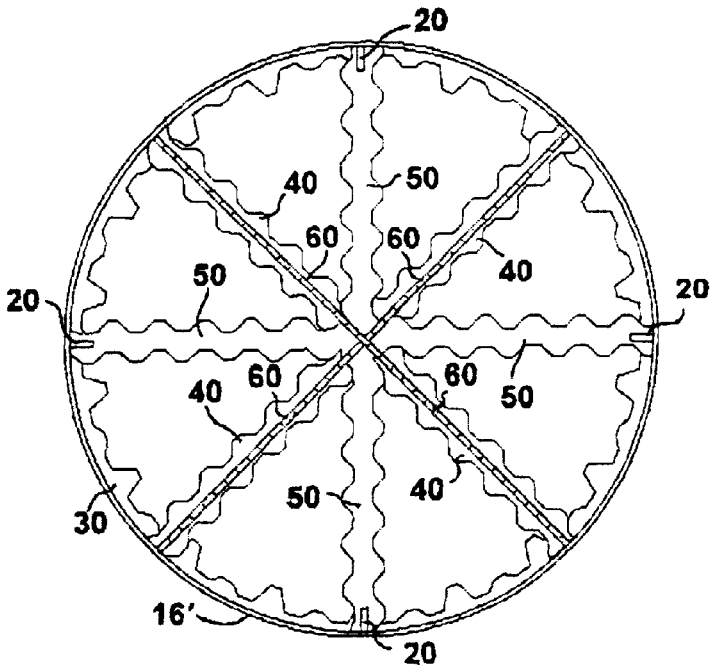

Referring to FIG. 5D, vertical crossbar elements 60 are illustrated superimposed above and in alignment with horizontal crossbars 40, to create a vertical array of teeth on an interior radial section of pipe/skirt 16' to diffuse radial components of flow interiorly of wall-mounted diffuser bars 20.

Figure 5E:
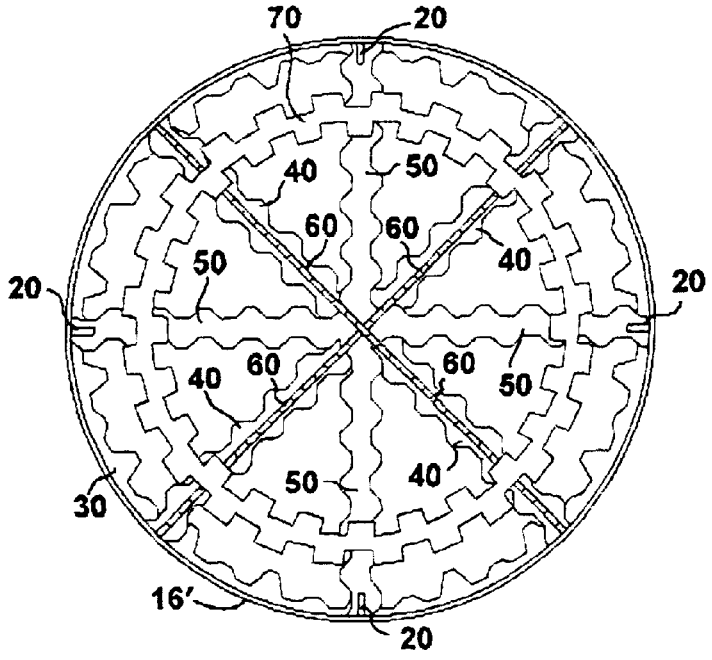

FIG. 5E illustrates a smaller diameter horizontal ring diffuser element 70 superimposed on (and optionally supported directly on) vertical crossbar element 60. Ring element 70 has a diameter less than the diameter of ring element 30, and further has teeth projecting from both its inner and outer circumference, so as to diffuse axial components of flow interiorly of ring 30 over a continuous circumferential planar segment of the flow area, including between the regions bounded by previously-stacked elements 40 and 50. Continuous ring 70 is further preferably aligned with the centerline of all of the outlets 18*a*.

Figure 5F:
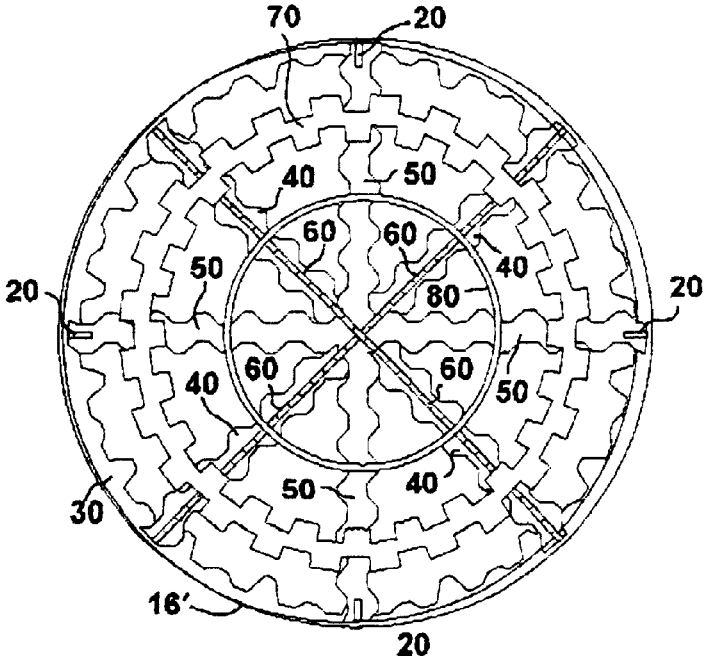
Figure 6:
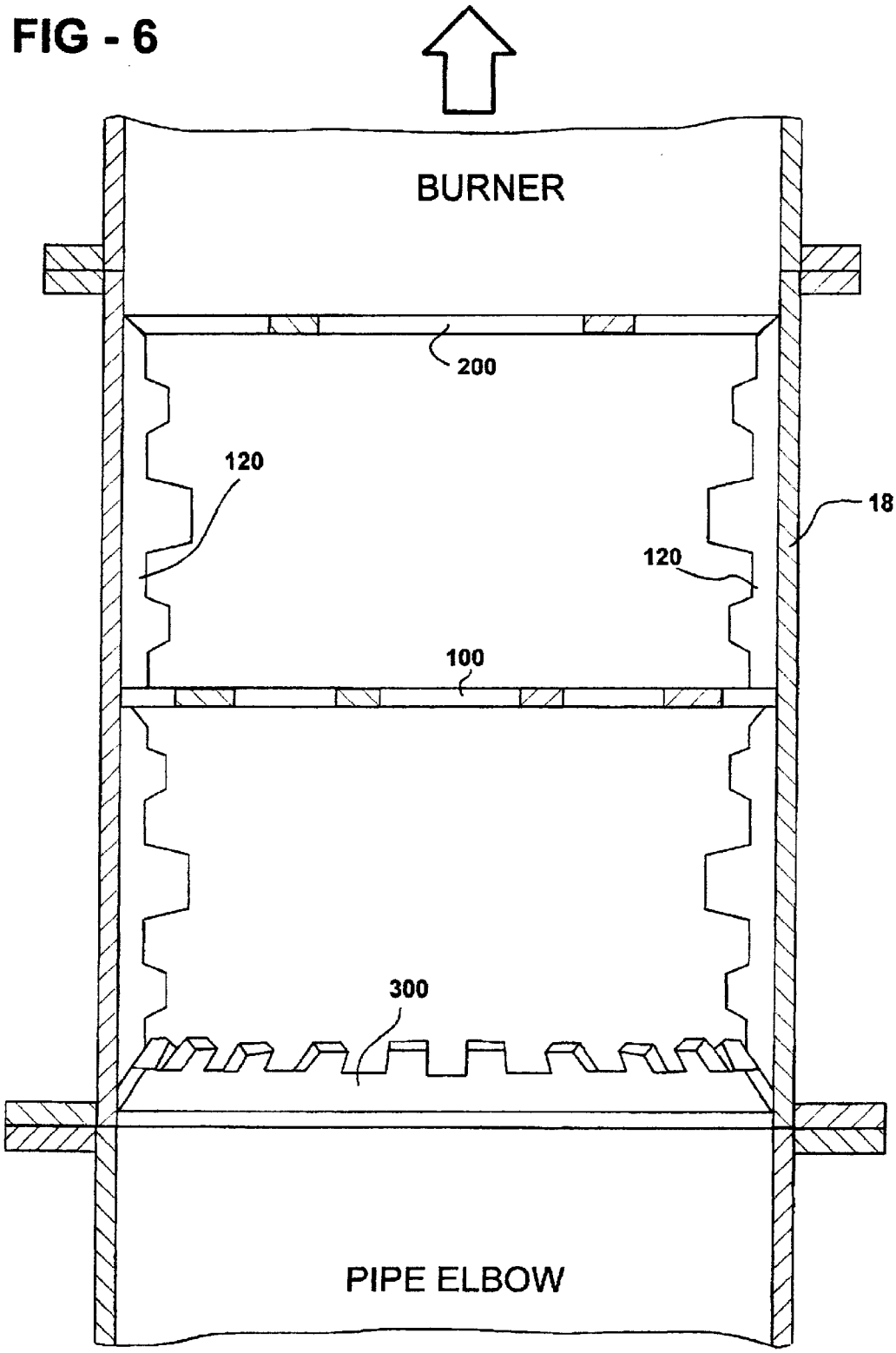
FIG. 6 is a side elevational view, in section, of an alternate pipe-mounted array of horizontal ring diffuser elements.
Figure 6A:
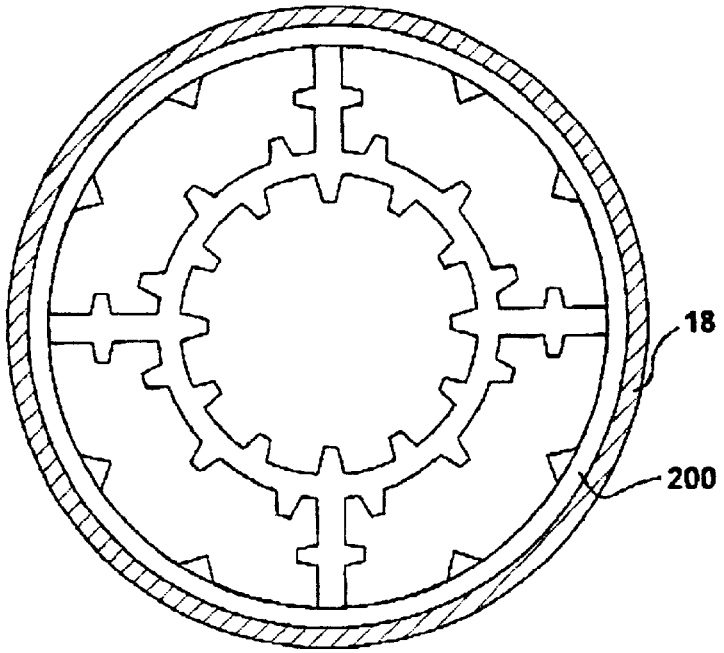
FIG. 6A is a plan view of the topmost ring diffuser element in FIG. 6.
Figure 6B:
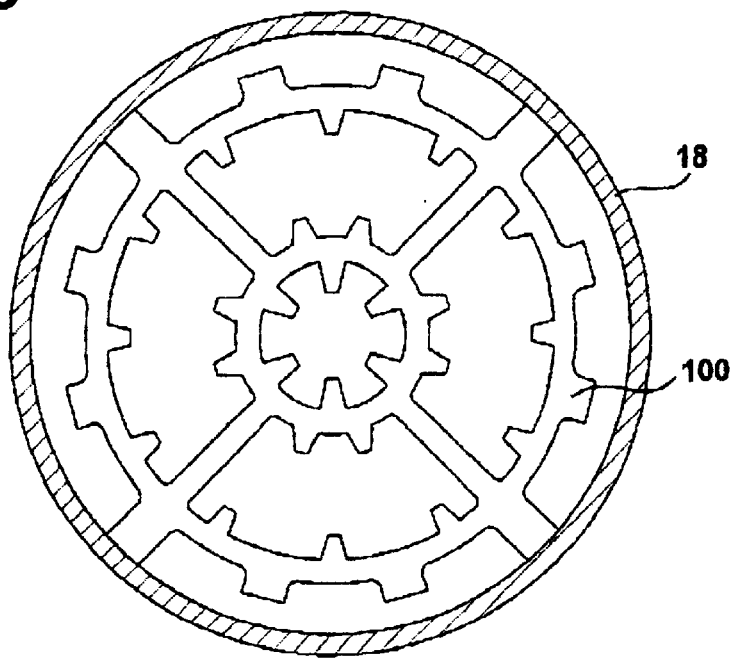
FIG. 6B is a plan view of the middle ring diffuser element in FIG. 6.
Figure 6C:
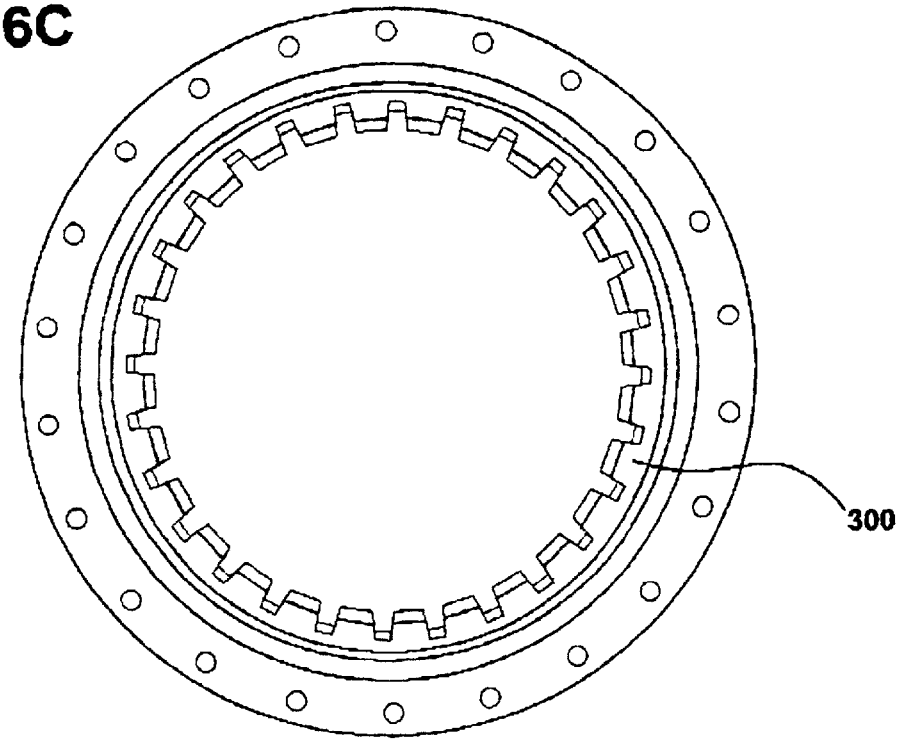
FIG. 6C is a plan view of the bottommost ring diffuser elements in FIG. 6.
Figure 6D:
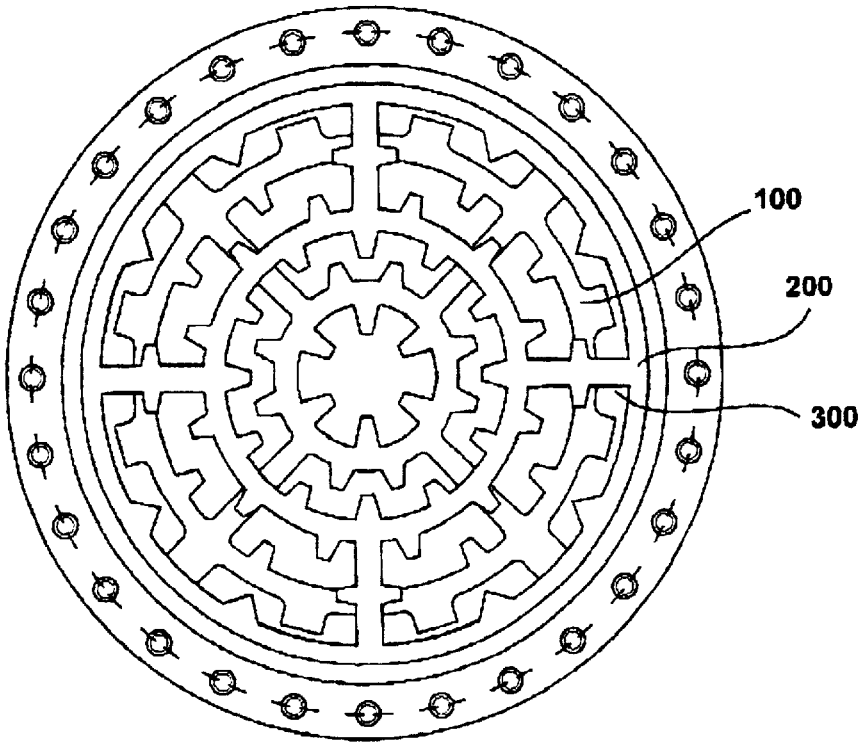
FIG. 6D is a plan view of the ring diffuser elements of FIGS. 6A–6C.

Referring to FIG. 5F, a vertical toothed ring element 80 having a diameter smaller than the diameters of ring elements 30 and 70 is secured in the center of the pipe/skirt immediately adjacent pipe outlets 18*a* so as diffuse radial components of flow interiorly of the other ring elements and especially those occurring immediately adjacent and between pipe outlets 18*a* due to the impingement of axial flow against the pipe outlet plate 19. This serves to reduce the likelihood that the eddying/swirling flow on plate 19 between pipe outlets 18*a* will tend to favor some outlets over others.

Referring next to FIGS. 6 and 6A–D, interior diffuser ring elements similar to those described above are shown applied to a single pipe diffusion scenario, in which flow through a single pipe needs to be diffused, typically over a fairly short distance. One possible use is immediately prior to or even combined with a combustion chamber burner as illustrated schematically in FIG. 6. Pipe 18 is illustrated with a stacked, spaced array of interior ring diffuser elements, 100, 200 and a peripheral ring diffuser element 300, along with vertical wall-mounted diffuser bars 120. The combination of wall-mounted vertical elements, a wall-mounted horizontal ring element, and the staggered arrangement of spaced interior ring elements ensures complete diffusion of all axial and radial components of uneven flow distribution over an extremely short length of pipe while minimizing pressure drop.

The foregoing illustrated embodiments of the invention set forth currently preferred examples, but will be subject to various minor modifications in terms of shape, placement, and the like now that I have disclosed these embodiments. For example, the invention is useful for pipe and outlet structures of other than cylindrical shape, and the term "ring" applies not only to true circular rings, but to any continuous toothed shape which occupies a generally horizontal, continuous portion of a planar segment of the flow path through the pipe. Accordingly, they are not intended to limit the invention beyond the scope of the following claims.

I claim:

1. A non-rotating distribution structure for airborne particulates comprising:

a continuous cylindrical annular chamber having an inlet for receiving airborne particulates and a plurality of outlets for distributing the airborne particulates to a combustion site;

said chamber being defined by generally cylindrical and concentric fixed inner and outer interior walls to have an upper and a lower end, the lower end being open to define the inlet, the upper end being contiguously connected to a plurality of outlets arranged around the annular chamber to receive upwardly flowing airborne particulates therefrom, and a plurality of diffuser bars arranged in parallel spaced relationship along the inner and outer interior wails between the lower and upper ends of the chamber, each diffuser bar having spaced portions of varying radial dimension extending into the annular chamber.

2. A structure as defined in claim 1 wherein said diffuser bar portions are teeth of alternatingly larger and smaller radial dimension.

3. A structure as defined in claim 1 further comprising additional tab-like diffuser structures disposed between said outlets.

4. A structure as defined in claim 1 further comprising additional diffuser tabs attached to and angularly extending from the inner interior wall adjacent the lower end of the chamber.

5. A structure as defined in claim 1 further comprising one or more diffuser rings mounted on and extending around the outer interior wall wherein each of said diffuser rings is characterized by portions of greater and lesser radial extension into said chamber.

6. A structure as defined in claim 1 further comprising a plurality of outlet pipes individually connected to said plurality of outlets for delivering airborne particulates to a combustion chamber, said outlet pipes further including a plurality of axially extending diffuser bars mounted on the inner and outer interior walls thereof in spaced parallel relationship and having portions of greater and lesser radial extension into the interior of said outlet pipes.

7. A structure as defined in claim 6 further comprising a plurality of axial diffuser rings disposed on the interiors of said outlet pipes in axially spaced relationship.

8. A non-rotating, multi-outlet distribution structure for airborne coal particulates on their way to a combustion chamber, comprising a continuous cylindrical flow chamber having an upper end and a lower end, an outlet wall terminating the upper end of the chamber, a plurality of distribution outlets formed in the outlet wall, the distribution outlets being symmetrically arranged around an axis coaxial with the flow chamber, a plurality of vertical diffuser bars arranged in parallel spaced vertical relationship along a wall of the flow chamber between the upper and lower ends of the chamber, each vertical diffuser bar having spaced portions of varying radial dimension extending into the flow chamber, and a horizontal diffuser bar disposed in the flow chamber between the vertical diffuser bars, the horizontal diffuser bar having spaced portions of varying radial dimension, the horizontal diffuser bar occupying a generally horizontal, continuous portion of a planar segment of the flow path through the chamber around which at least a portion of the particulate flow may pass unimpeded.

9. The structure of claim 8, wherein the horizontal diffuser bar comprises a ring spaced from the wall of the flow chamber.

10. The structure of claim 9, wherein the spaced portions of the ring extend generally perpendicularly to the axis of the flow chamber.

11. The structure of claim 9, wherein the spaced portions of the ring extend generally parallel to the axis of the flow chamber.

12. The structure of claim 9, wherein a plurality of rings of different diameter are spaced axially between the upper and lower ends of the flow chamber.

13. The structure of claim 8, wherein the flow chamber has an annular volume defined by generally cylindrical and concentric fixed inner and outer walls, and the vertical and horizontal diffuser bars are located in the annular volume.

* * * * *